US008727383B2

(12) United States Patent
Cordes et al.

(10) Patent No.: US 8,727,383 B2
(45) Date of Patent: May 20, 2014

(54) TELESCOPIC VACUUM CLEANER SUCTION TUBE WITH AN INTERLOCKING ELEMENT IN THE FORM OF A BOW SPRING

(75) Inventors: August Cordes, Sundern (DE); Gisela Cordes, legal representative, Sundern (DE); Martin Cordes, Sundern (DE); Stephan Cordes, Arnsberg (DE)

(73) Assignee: Fischer Rohrtechnik GmbH, Achern-Fautenbach (DE)

( * ) Notice: Subject to any disclaimer, the term of this patent is extended or adjusted under 35 U.S.C. 154(b) by 583 days.

(21) Appl. No.: 11/607,389

(22) Filed: Dec. 1, 2006

(65) Prior Publication Data

US 2007/0143955 A1 Jun. 28, 2007

(30) Foreign Application Priority Data

Dec. 23, 2005 (DE) ..... 10 2005 061 923

(51) Int. Cl.
*A47L 9/24* (2006.01)

(52) U.S. Cl.
USPC ..... 285/7; 285/303; 285/317

(58) Field of Classification Search
USPC ..... 285/298, 302, 303, 308, 309, 317, 256, 285/7
See application file for complete search history.

(56) References Cited

U.S. PATENT DOCUMENTS 239,827 A * 4/1881 Newman ..... 285/308
1,205,131 A * 11/1916 Beck ..... 285/303
1,770,669 A * 7/1930 Martinet ..... 285/308
2,023,428 A * 12/1935 Liebhardt ..... 285/110
2,805,089 A * 9/1957 Hansen ..... 285/317
2,898,130 A * 8/1959 Hansen ..... 285/277
2,901,269 A * 8/1959 Rickard ..... 285/39
3,207,535 A * 9/1965 Wilson ..... 285/86
3,347,575 A * 10/1967 Morris ..... 403/107
3,534,988 A * 10/1970 Lindsey ..... 285/305
5,046,761 A * 9/1991 Cordes ..... 285/7
5,098,241 A 3/1992 Aldridge et al. ..... 411/433
5,742,976 A * 4/1998 Bensussen et al. ..... 15/323
6,461,074 B2 * 10/2002 Taylor ..... 403/378
2004/0111828 A1 * 6/2004 Evans ..... 15/414
2006/0165479 A1 * 7/2006 Lorenz ..... 403/223

* cited by examiner

*Primary Examiner* — James Hewitt

(74) *Attorney, Agent, or Firm* — Roberts Mlotkowski Safran & Cole, P.C.; David S. Safran

(57) ABSTRACT

A telescopic vacuum cleaner suction tube (1) having an outer tube (2) and an inner tube (3) with snap-in depressions (7). The inner tube is telescopically arranged in the outer tube. The suction tube also includes an antitwisting mechanism (4*d;* 16) and an interlocking device with a snap-in element (15) that is disengaged from a snap-in depression (7) by an actuating element (5) situated about diametrically opposite thereof. The interlocking device includes a spring (6) that positively encompasses at least the inner tube (3) and engages the snap-in element (15) into the nearest snap-in depression (7) of the inner tube (3). The interlocking device and telescoping tubes ensure that the tubes are always securely interlocked and able to withstand shock-like compressive forces, namely while simultaneously providing for an ergonomic handling.

5 Claims, 19 Drawing Sheets

15
6

VII
14
12
13
6
17

8
15
VIII 6
12
14
13

XXXV
XXXVI
XXXVII
XXXVII
XXXI
XXXII
XXXIII
XXXIII
6
8
12
13
14
15

TELESCOPIC VACUUM CLEANER SUCTION TUBE WITH AN INTERLOCKING ELEMENT IN THE FORM OF A BOW SPRING

TECHNICAL FIELD

The invention pertains to a telescopic vacuum cleaner suction tube with an outer tube, an inner tube that features snap-in depressions and is telescopically arranged in the outer tube, an antitwisting mechanism and an interlocking device with a snap-in element that can be disengaged from the snap-in depression by means of an actuating element situated about diametrically opposite thereof, wherein the interlocking device consists of a bow spring that positively encompasses at least the inner tube and once again engages the snap-in element into the next snap-in depression of the inner tube referred to the telescoping direction under the prestress of a spring.

BACKGROUND ART

A telescoping vacuum cleaner suction tube of this type is known from DE 39 29 399 A1. In this case, the bow spring engages into recesses of the actuating element with the ends that face one another. When the actuating element is depressed, the bow spring merely acts as a dimensionally stable pressure transmitting element, by means of which a snap-in element situated opposite of the actuating element needs to be disengaged from the snap-in depression of the inner tube. This snap-in element consists of a flattened region that lies diametrically opposite of the bow spring on the actuating element. In order to once again engage the snap-in element into a snap-in depression, the snap-in element is constantly subjected to the force of a prestressed leaf spring that persistently presses the snap-in element in the direction of the snap-in depressions on the surface of the inner tube. An interlocking device of this type always requires two springs, namely a) a bow spring that serves as pressure transmitting element and does not exert a spring force as such, b) and a leaf spring that has the tendency to constantly press the snap-in element into one of the snap-in depressions of the inner tube under a prestress.

The bow spring has an annular cross-section and the snap-in depression has a cross-section in the shape of a graduated circle. When shock-like compressive forces are exerted upon the ends of the outer and/or inner tube, the snap-in element may slide upward and out of the snap-in depression on an oblique plane against the force of the leaf spring, wherein the snap-in element is disengaged and an undesirable telescopic adjustment takes place. The leaf spring that presses the snap-in element back into the snap-in depression not only increases the manufacturing and assembly expenditures, but also requires a sleeve-like handle around the outer and inner tubes in order to accommodate and simultaneously secure the leaf spring such that not only the assembly expenditure is increased, but also the manufacturing expenditure.

DISCLOSURE OF THE INVENTION

Based on this state of the art, the invention aims to develop a telescopic vacuum cleaner suction tube of the initially cited type that significantly lowers the manufacturing and assembly expenditures of the interlocking device and ensures that the tubes are always securely interlocked and able to withstand shock-like compressive forces, namely while simultaneously providing for an ergonomic handling.

This objective is attained, according to the invention, in connection with the initially cited preamble in that the bow spring consists of an annular spring of rectangular or circular cross section that alternatively encompasses the inner tube or a guide sleeve or the outer tube, namely not only positively, but also non-positively, wherein the free ends of the spring need to be spread apart by the actuating element in order to disengage the interlocked tubes by lifting the snap-in element out of the snap-in depression.

This design always requires only one spring that needs to simultaneously fulfill several functions, namely:

a) The prestress of the bow spring automatically presses the snap-in element integrally connected thereto into the respectively nearest snap-in depression. A second spring is unnecessary.

b) When the ends of the bow spring are spread apart, its prestress increases and the snap-in element is lifted out of the snap-in depression because the snap-in element changes its position and disengages from the snap-in depression when the actuating element is depressed in order to spread apart the spring ends.

c) The actuating element can be realized in the form of a push-button or a slide or a sliding sleeve and is constantly pressed into its unstressed starting position under the prestress of the bow spring such that another separate return spring is not required.

In contrast to the entire state of the art, this solution for the first time utilizes a positively and non-positively acting bow spring for the moving mechanism of an interlocking device that is disengaged by spreading apart the ends of the bow spring and automatically engaged under the prestress of the bow spring.

If the bow spring has a rectangular cross section, the corresponding snap-in depressions that have a similar, adapted geometry and are flatly embossed in the inner tube are so minimal that their flow cross section and therefore the flow resistance within the inner tube is substantially lowered in comparison with the state of the art, in which semicircular snap-in depressions are used. The flow resistance is essentially defined by the known antitwisting mechanism that is also not required in this case. The entire interlocking device only consists of two parts, namely a bow spring and an actuating element in the form of a push-button or a slide, such that the manufacturing and assembly expenditures are significantly lowered.

When the free ends of the bow spring are spread apart by the actuating element, the about diametrically opposite snap-in element is surprisingly lifted out of the snap-in depression, wherein this was not expected at all when the opposite region is spread apart. This may be the reason why no person skilled in the art has attempted to realize such a function in a corresponding interlocking device prior to the application date. It was also surprisingly determined that the interlocking device that merely consists of the bow spring and the actuating element makes it possible to always ensure that the tubes are reliably interlocked and that the interlocking device can be quickly disengaged in order to initiate a telescoping process.

According to one advantageous additional development of the invention, the free ends of the bow spring are either bent inward or outward in a funnel-shaped fashion in the vicinity of the actuating element in order to always ensure a low-friction and trouble-free engagement with the actuating element.

According to a first embodiment, the snap-in depressions in the inner tube have a flat rectangular shape and cooperate with a bow spring of rectangular cross section.

According to a first embodiment, the actuating element is realized in the form of a push-button that engages into the intermediate space between the ends of the bow spring that are bent inward or outward in a funnel-shaped fashion with its end that faces the bow spring and has the shape of a wedge or a cone, wherein the push-button is raised into a raised position within a surrounding housing under the prestress of the bow spring in its engaged position. Consequently, the bow spring also fulfills the function of a return spring for returning to push-button into its starting position, wherein the bow spring simultaneously ensures that its snap-in element reliably engages into the respective snap-in depression under the same spring prestress due to the fact that it positively and non-positively encompasses the inner tube.

In order to disengage the interlocked tubes, the conical end face of the push-button is pressed in the direction of the surface of the inner tube, namely into the intermediate space between the ends of the bow spring that are bent inward or output in a funnel-shipped fashion, wherein the bow spring is simultaneously spread apart such that it disengages from the snap-in depression of the inner tube with its diametrically opposite snap-in element and the inner tube can either be pushed into the outer tube or pulled out thereof as required.

According to a second advantageous embodiment of the invention, the actuating element consists of a slide that is arranged on the outer tube such that it can be moved parallel to the direction of the longitudinal symmetry axis. This slide features two cone surfaces that adjoin the ramps formed by the bent ends of the bow spring in a paired fashion and are connected to one another similar to an hourglass at their opposite pointed regions such that the movement of the slide in either direction parallel to the longitudinal symmetry axis of the tube causes the bow spring to be spread apart. This makes it possible to ergonomically pull the slide in direction of the handle, e.g., in order to pull apart the telescopic tubes, and to press the slide in the direction of the nozzle part when the tubes are pushed into one another, i.e., the movement of the slide in one or the other direction is coordinated with the corresponding telescoping process.

The cone surfaces preferably form an angle $\alpha$ between 30° and 60° with a plane extending through the longitudinal symmetry axis, preferably an angle $\alpha$ of 45°, and are realized in the form of plane cone surfaces of a quadrangular pyramid.

According to another embodiment, the cone surfaces may also consist of partial generated surfaces of two straight circular cones. In this case, the contact surface with the ramps of the bow spring consists of two respective surface lines of the respective circular cone such that the ends of the bow spring can be spread apart in a low-friction fashion.

According to an advantageous additional development of the invention, the actuating element is arranged on a widened end region of the outer tube that faces the inner tube together with a guide sleeve that is described further below, namely in the form of a push-button or in the form of a slide. Due to these measures, the flow cross section at the end of the outer tube is preserved in its entirety despite the installation of the guide sleeve and the actuating element, wherein the guide sleeve may conventionally serve for holding the actuating element as well as for sealing the intermediate space between the inner tube and the outer tube.

According to another particularly advantageous embodiment of the invention, the slide is provided with guide grooves on its surface areas that face the outwardly bent free ends of the bow spring, wherein these free ends of the bow spring are guided in said guide grooves and spread apart in order to disengage the interlocked tubes when the slide is displaced in either direction parallel to the longitudinal symmetry axis of the tubes.

When using a bow spring with circular cross section according to the state of the art and an actuating element in the form of a slide, said slide is advantageously realized in the form of a sliding sleeve that completely encompasses the outer tube and features a safety projection on its inner surface that lies nearest the snap-in element, wherein said safety projection engages underneath the snap-in element in exactly its central region in the engaged position. This safety projection ensures that shock-like impulses exerted upon one end or both ends of the tubes do not result in the tubes being undesirably pushed into one another—in contrast to the state of the art. The snap-in element can only disengage from the snap-in depression once the slide is displaced relative to the snap-in element in one of the two possible directions in the central region of the safety projection. Otherwise, this disengagement is prevented by the safety projection.

In order to ensure a short actuating path and therefore a fast disengagement of the safety projection, it is rounded in the direction of the snap-in element or provided with conical lateral surfaces.

If the slide is designed with guide grooves for spreading apart the ends of the bow spring, the curved paths of these guide grooves are adapted to the geometry of the safety projection in such a way that the process of spreading apart the ends of the bow spring can only begin after a short linear displacement within a straight section of the curved path. This defined progression of the curved paths makes it possible to preclude any jamming between the safety projection and the snap-in element when the interlocked tubes are disengaged.

The bow spring advantageously consists of spring steel and is positively and non-positively arranged on a circumferential groove of a guide sleeve such that it can be spread apart, wherein said guide sleeve is stationarily arranged at the end of the outer tube in an intermediate space between the inner tube and the outer tube. Two diametrically opposite regions of the bow spring feature openings, into one of which the ends of the bow spring engage and into the other one of which the snap-in element engages.

The antitwisting mechanism conventionally consists of a longitudinal groove that extends along the longitudinal symmetry axis and into which a projection of the guide sleeve positively engages. In order to make it possible to manufacture the inner tube in only one embossing step and with only one embossing die, the longitudinal groove is arranged in the inner tube in the region of the snap-in depressions.

BRIEF DESCRIPTION OF THE DRAWINGS

Several embodiments of the invention are illustrated in the figures. The figures show:

FIG. 17, a section through the push-button housing according to. FIGS. 1 to 5 along the line XVII/XVII in FIG. 18;

PREFERRED EMBODIMENT FOR CARRYING OUT THE INVENTION

Figure 1:
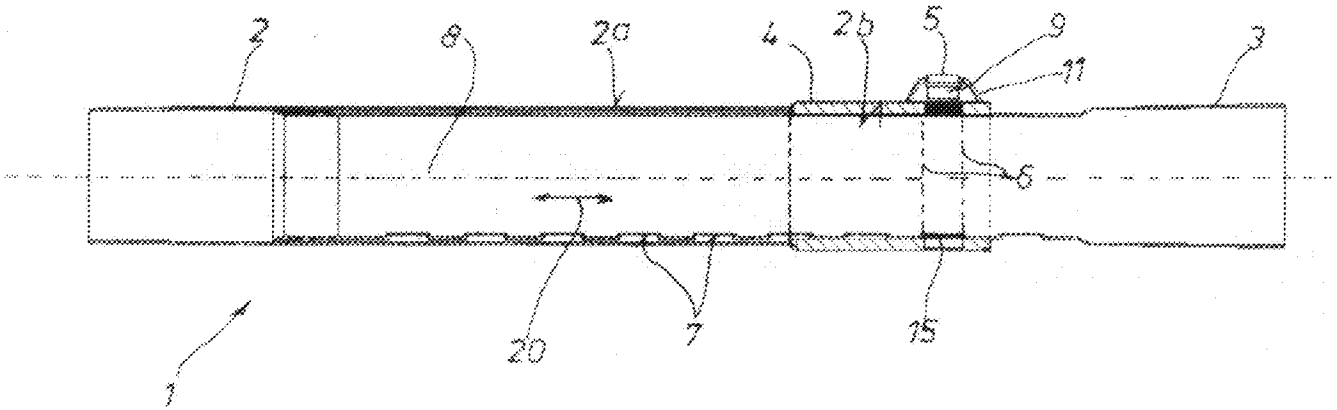
FIG. 1, a longitudinal section through a telescopic vacuum cleaner suction tube with an actuating element in the form of a push-button and a bow spring of rectangular cross sections.

In all figures, the telescopic vacuum cleaner suction tube is always identified by the reference symbol 1, the outer tube is identified by the reference symbol 2, its inner tube is identified by the reference symbol 3, the guide sleeve is identified by the reference symbol 4, the actuating element is identified by the reference symbol 5, the bow spring is identified by the reference symbol 6, the snap-in depressions are identified by the reference symbol 7 and the longitudinal symmetry axis is identified the reference symbol 8.

The individual embodiments can essentially be distinguished by the cross-sectional shape of the bow spring 6 as well as the design of the actuating element 5 in the form of either a push-button 9 or a slide 10.

Figures 2, 2A, 3:
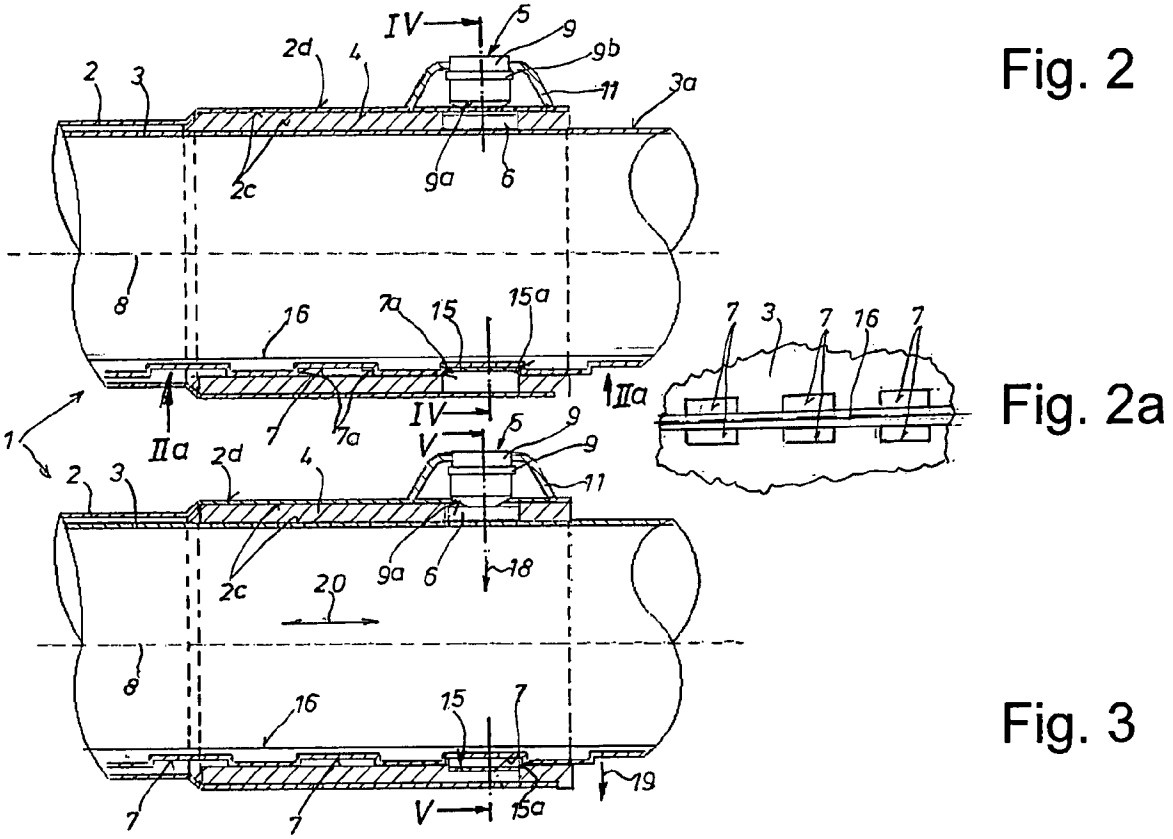
FIG. 2, a longitudinal cross section in the region of the push-button, namely in the engaged position and in the form of an enlarged representation referred to FIG. 1.
FIG. 2*a*, a partial view of the snap-in depressions and the groove for realizing the antitwisting mechanism in the direction of the arrow IIa in FIG. 2.
FIG. 3, a view according to FIG. 2 in the disengaged position of the bow spring, in which the snap-in element is lifted out of the snap-in depression.
Figure 5:
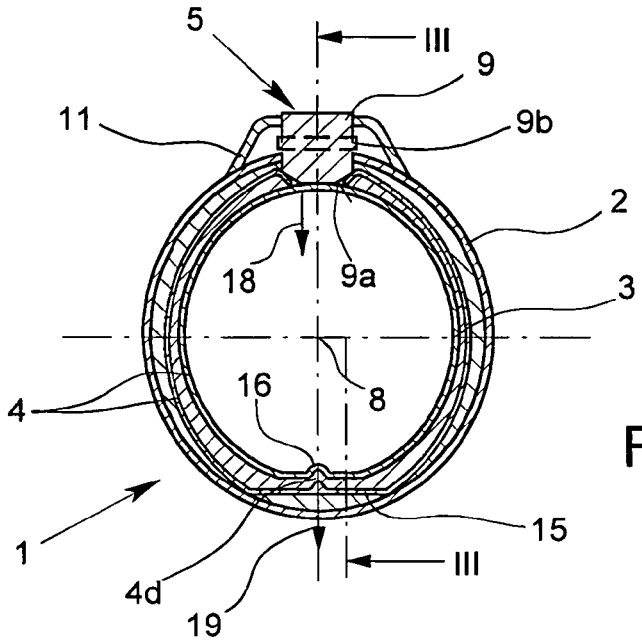
FIG. 5, a section along the line V/V in FIG. 3.
Figures 6, 7, 8:
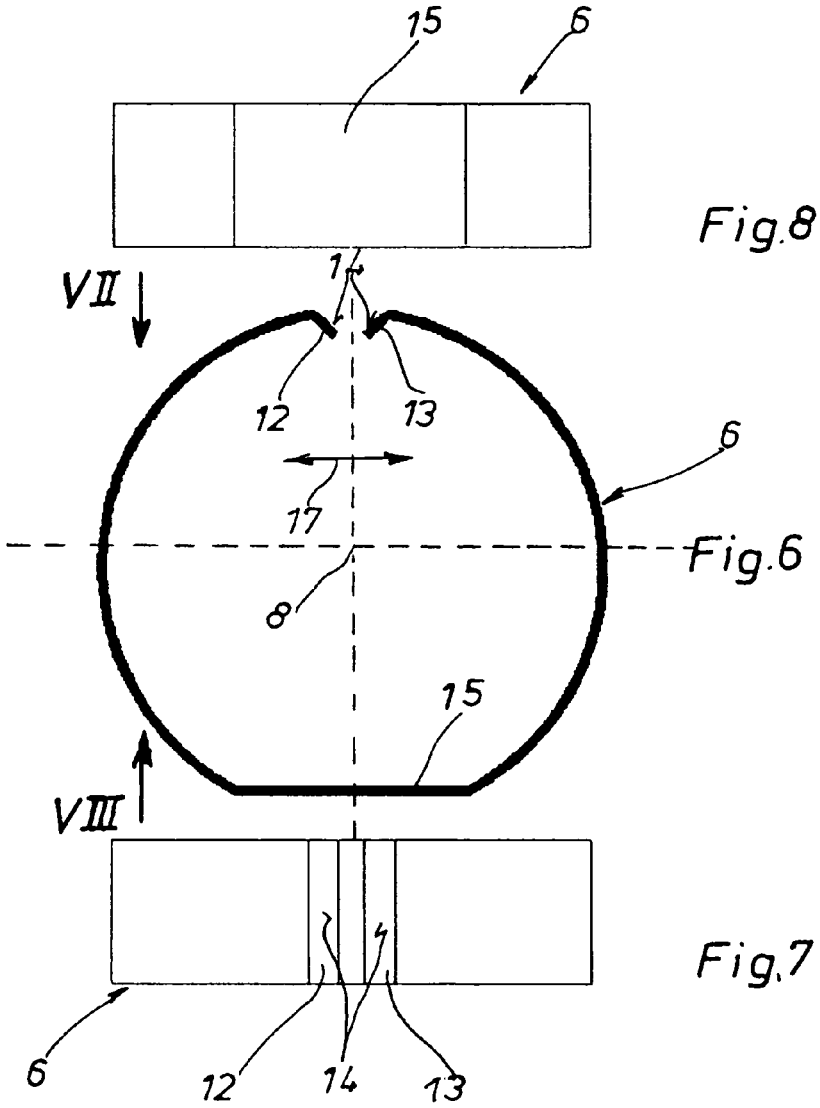
FIG. 6, a view of the bow spring according to FIGS. 1 to 5.
FIG. 7, a top view of the bow spring in the direction of the arrow VII in FIG. 6.
FIG. 8, a bottom view of the bow spring in the direction of the arrow VIII in FIG. 6.
Figure 21:
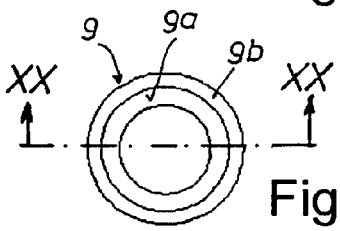
FIG. 21, a view of the push-button in the direction of the arrow XXI in FIG. 22.
Figure 20:
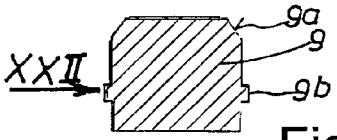
FIG. 20, a section through the push-button along the line XX/XX in FIG. 21.
Figure 19:
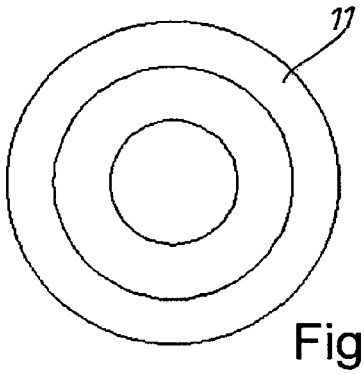
FIG. 19, a top view of the push-button housing in the direction of the arrow XIX in FIG. 17.
Figure 18:
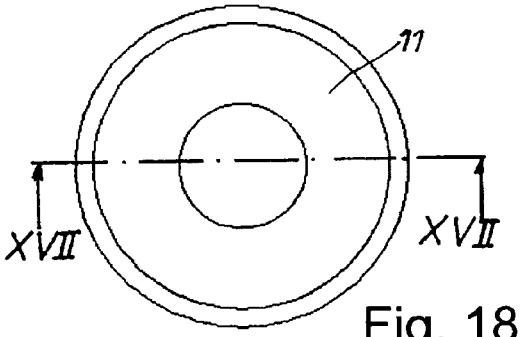
FIG. 18, a bottom view of the push-button housing in the direction of the arrow XVIII in FIG. 17.
Figure 17:
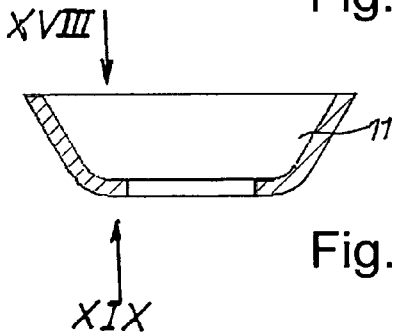

According to a first embodiment that is shown in FIGS. 1 to 8, the actuating element 5 is realized in the form of a push-button 9. FIGS. 2 and 3 also show that the bow spring 6 in FIGS. 6 to 8 is realized with the cross-sectional shape of an elongated rectangle. The push-button 9 is surrounded by a push-button housing 11 that is rigidly connected to the upper side 2*a* of the outer tube, e.g., by means of bonding. The shape of the push-button 9 is illustrated in detail in FIGS. 20 to 22, and the shape of the push-button housing 11 is illustrated in detail in FIGS. 17 to 19.

Figure 22:
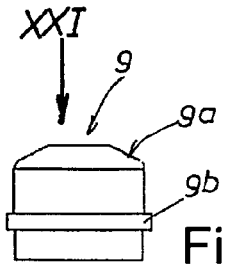
FIG. 22, a view of the push-button in the direction of the arrow XXII in FIG. 20.

The bow spring 6 according to FIGS. 6 to 8 is provided with ends 12, 13 that are bent inward such that they form a funnel-shaped intermediate space 14, into which the push-button 9 protrudes with its cone surface 9*a* (see FIG. 22). The bow spring 6 is flattened in the section that lies opposite of the funnel-shaped intermediate space 14 such that this section protrudes in the direction of the longitudinal symmetry axis 8. This flattened section forms the snap-in element 15 that positively engages into corresponding rectangular snap-in depression 7 of the inner tube 3 (see FIGS. 2 and 3).

Figure 4:
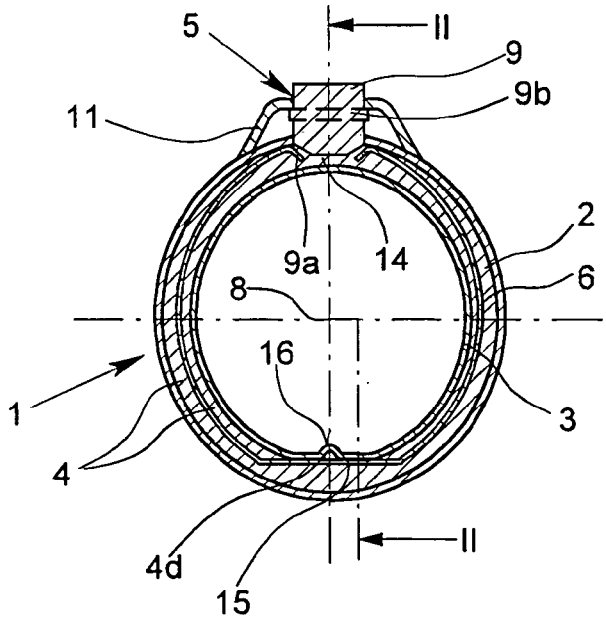
FIG. 4, a section along the line IV/IV in FIG. 2.
Figure 25:
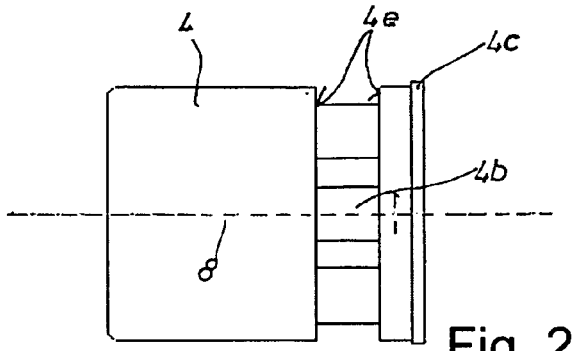
FIG. 25, a view in the direction of the arrow XXV in FIG. 23 with the passage area for a push-button or a slide as well as the ends of the bow spring.
Figure 24:
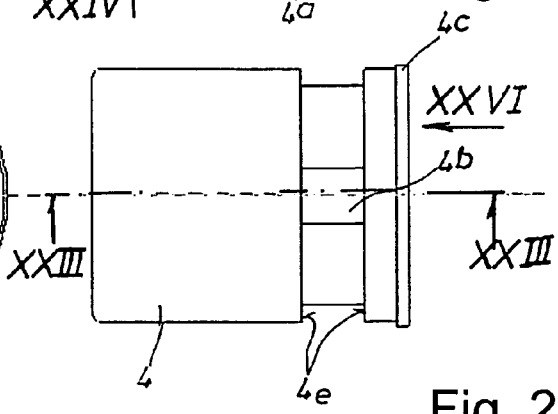
FIG. 24, a bottom view of the guide sleeve in the direction of the arrow XXIV in FIG. 23 with the passage area for the snap-in element of the bow spring.

In the closed position of the bow spring 6 according to FIGS. 1, 2 and 4, it is positively and non-positively accommodated in a groove 4*e* of the guide sleeve 4 (see FIGS. 24 and 25) such that the push-button according to FIGS. 1, 2 and 4 is pressed into its raised position that signals the engaged position of the bow spring 6. In this case, the bow spring 6 with its snap-in element 15 not only forms the interlocking device of the telescopic vacuum cleaner suction tube 1, but also the return spring for the push-button 9 that serves for holding this push-button in its raised position according to FIGS. 1, 2 and 4 and therefore in the engaged position.

The guide sleeve 4 according to FIGS. 23 to 26 is provided with an opening 4*a* that serves as a passage for the snap-in element 15 of the bow spring 6, as well as a second, diametrically opposite opening 4*b* that serves as a passage for the ends 12, 13 of the bow spring 6 as well as the push-button 9 and the slide 10. It furthermore features a collar 4*c*, by means of which it is non-rotatably and immovably fixed on the end face of the outer tube 2, namely in a widening 2*b* of the outer tube 2 on its end region that faces the inner tube 3.

Figure 23:
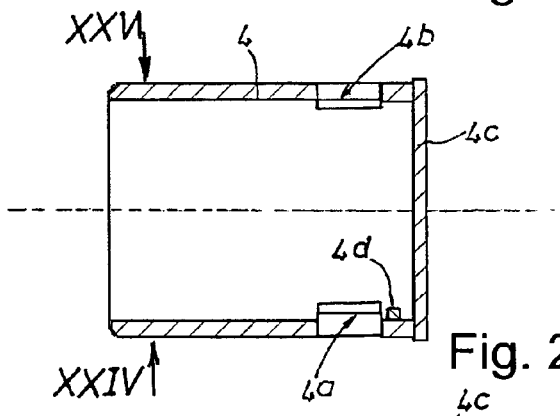
FIG. 23, a section through the guide sleeve along the line XXIII/XXIII in FIG. 24.
Figure 26:
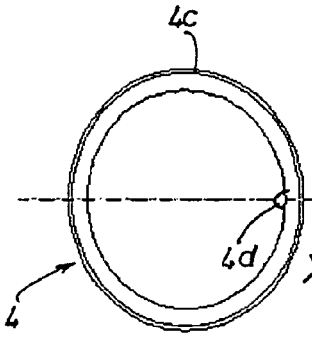
FIG. 26, a view of the end face of the guide sleeve in the direction of the arrow XXVI in FIG. 24.

The guide sleeve according to FIG. 23 is provided with an antitwisting mechanism in the form of a projection 4*d* that forms the antitwisting mechanism 4*d*/16 together with a groove 16 in the inner tube 3 such that the inner tube 3 of the telescopic vacuum cleaner suction tube 1 cannot be turned relative to the outer tube 2, but only displaced along the longitudinal symmetry axis 8.

This groove extends centrally through the region of the snap-in depressions 7 of the inner tube 3 such that this groove 16 as well as the snap-in depressions 17 can be produced in a single embossing process of the inner tube 3.

This embossing of the snap-in depressions 7 and the groove 16 is illustrated in the partial view according to FIG. 2*a*.

The engaged position of the telescopic vacuum cleaner suction tube 1 is illustrated in FIGS. 1, 2 and 4. In this position, the snap-in element 15 of the bow spring 6 is engaged with the nearest snap-in depression 7 of the inner tube 3. The push-button 9 is simultaneously situated in the raised position. The push-button 9 is contained in the push-button housing 11 by its collar 9*b*. The push-button 9 adjoins the ends 12, 13 of the bow spring 6 that are bent inward in a funnel-shaped fashion with its cone surface 9*a*. This means that a funnel-shaped intermediate space 14 for the push-button 9 is formed between these ends 12, 13 of the bow spring 6. When the push-button is depressed in the direction of the arrow 18 in FIGS. 3 and 5, the cone surface 9*a* slides down on the funnel-shaped ends 12, 13 of the bow spring 6 and spreads these ends apart toward both sides in the direction of the double arrow 17 in FIG. 6. This spreading movement causes the snap-in element 15 to be lifted out of the snap-in depression 7 in the direction of the arrow 19 in FIGS. 3 and 5. Consequently, the inner tube 3 and the outer tube 2 are no longer engaged by means of the bow spring 6 and the guide sleeve 4 with the snap-in depression 7. The telescopic vacuum cleaner suction tube 1 can subsequently be displaced parallel to the longitudinal symmetry axis 8 in both directions as indicated by the double arrow 20 in FIGS. 1, 3 and 5.

After the push-button 9 is released, the snap-in element 15 engages into the nearest snap-in depression 7 under the prestress of the bow spring 6 and the push-button 9 is once again raised into its starting position according to FIGS. 1, 2 and 4. The engaged position of the telescopic vacuum cleaner suction tube 1 is reached in this position. In this engaged position, the inner tube 3 can no longer be undesirably pushed into the outer tube 2, namely even if shock-like impulses are exerted upon the ends of the outer tube 2 and/or the inner tube 3 because the front edge 15*a* of the snap-in element 15 of the bow spring 6 positively adjoins the corresponding edge 7*a* of the respective snap-in depression 7 and no longer allows any relative axial movement between the tubes 2, 3. In this position, it is not possible to spread apart the bow spring 6 as it would be required in order to disengage the interlocked tubes because the bow spring 6 cannot be spread apart even if shock-like impulses are exerted upon the front edges 15*a* of the snap-in element 15 due to the edge 15*a* "digging" into the edge 7*a*.

The entire interlocking mechanism consists of only two parts, namely the bow spring 6 and the actuating element 5, in this case a push-button 9 in connection with a known guide sleeve 4. This reduces the interlocking device to only two parts, namely the bow spring 6 in connection with the actuating element 5. The bow spring 6 altogether fulfills 3 functions:

a) The function of an interlocking spring in that its prestress causes the snap-in element 15 to slide into the nearest snap-in depression 7 and to be held therein under prestress.

b) The function of a force transmitting element in that it lifts the snap-in element 15 out of the respective snap-in depression 7 when it is spread apart by the push-button 9 or the slide 10 or another actuating element and its prestress is increased.

c) The function of a return spring referred to the actuating element 5 in order to hold the actuating element in its starting position when the snap-in element 15 is engaged with the respective snap-in depression 7.

The invention also makes it possible to realize the actuating element 5 in the form of a slide 10. A first embodiment of such a slide 10 is illustrated in FIGS. 9 to 12, wherein the shape of the bow spring 6 corresponds to that shown in FIGS. 6 to 8, and wherein the free ends 12, 13 are no longer bent inward, but rather outward and thus form a funnel-shaped intermediate space 14 referred to the actuating element 5 in the form of a slide 10. In other respects, components that correspond to FIGS. 1 to 8 are identified by the same reference symbols. The guide sleeve 4 is realized identical to the embodiment of the guide sleeve shown in FIGS. 23 to 26.

In this embodiment, the slide 10 is positively coupled with the slide housing 11 a that is stationarily fixed on the outer surface 2*a* of the outer tube 2. The slide 10 is positively guided within this slide housing 11*a*. The outer tube 2 also features a widening 2*b* in the vicinity of its end facing the inner tube 3 in this embodiment, wherein the guide sleeve 4 is accommodated in said widening such that the entire flow cross section of the inner tube 3 is preserved at this location. According to FIGS. 9 and 10, the slide 10 can be displaced parallel to the longitudinal symmetry axis 8 of the telescopic vacuum cleaner suction tube 1, namely in both directions indicated by the arrow 21. The snap-in element 15 is disengaged from the respective snap-in depression 7 during a displacement in either direction indicated by the double arrow 21 in FIG. 9 because the slide 10 according to FIGS. 15 and 16 has an hourglass shape and is situated in its engaged position, in which it is held under the prestress of the bow spring 6, when it is in contact with the ends 12, 13 of the bow spring 6 according to FIG. 11, i.e., at the narrowest point of its a hourglass shape.

Figure 15:
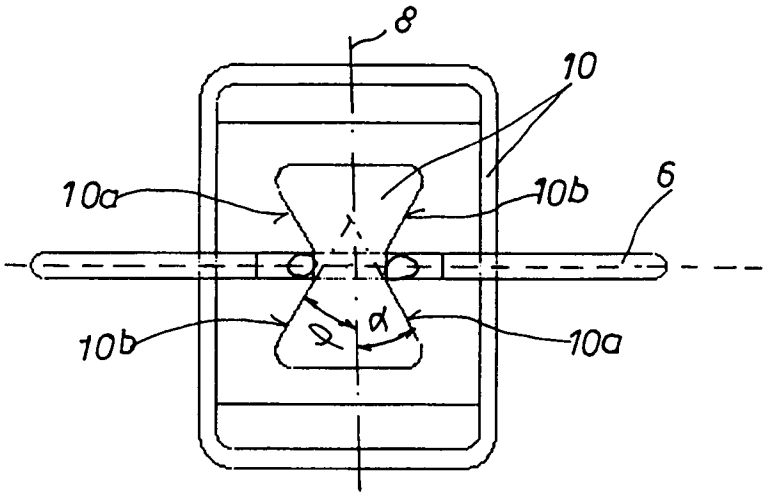
FIG. 15, a bottom view of the slide with the bow spring according to FIG. 13 in its engaged position, namely without the outer and inner tubes and without the guide sleeve.
Figure 16:
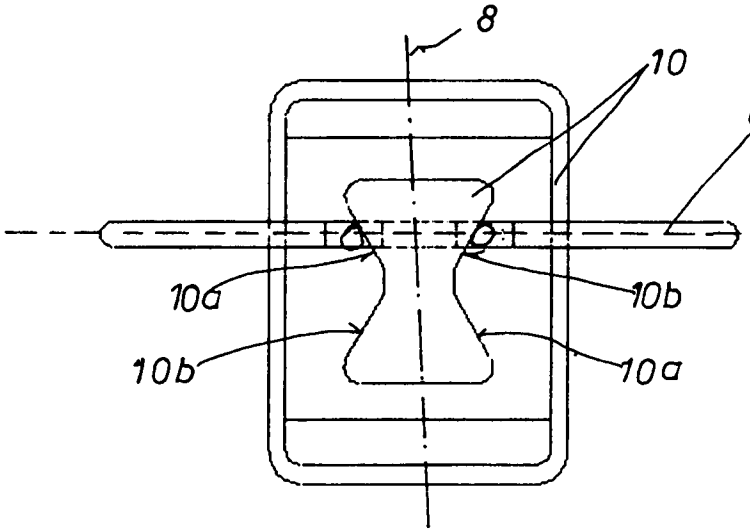
FIG. 16, a bottom view according to FIG. 15 of the slide in the disengaged position, in which the bow spring is spread apart.

If the slide 10 is only realized in a wedge-shaped fashion on one side, it is also possible to actuate the snap-in element 15, however, not quite as advantageously as with an optional displacement in both directions according to FIGS. 15 and 16.

Figure 9:
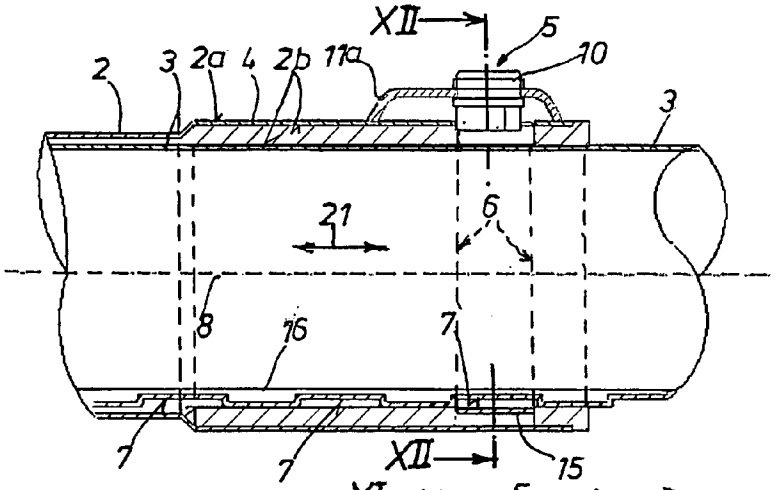
FIG. 9, a partial view of a longitudinal cross section in the region of an actuating element in the form of a slide that corresponds to that shown in FIG. 2, namely in the engaged position of the snap-in element.
Figure 10:
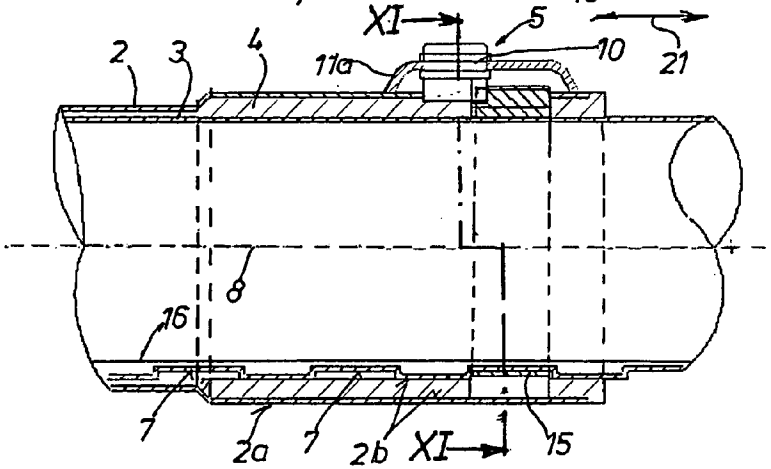
FIG. 10, a section according to FIG. 9 in the disengaged position of the snap-in element.
Figure 12:
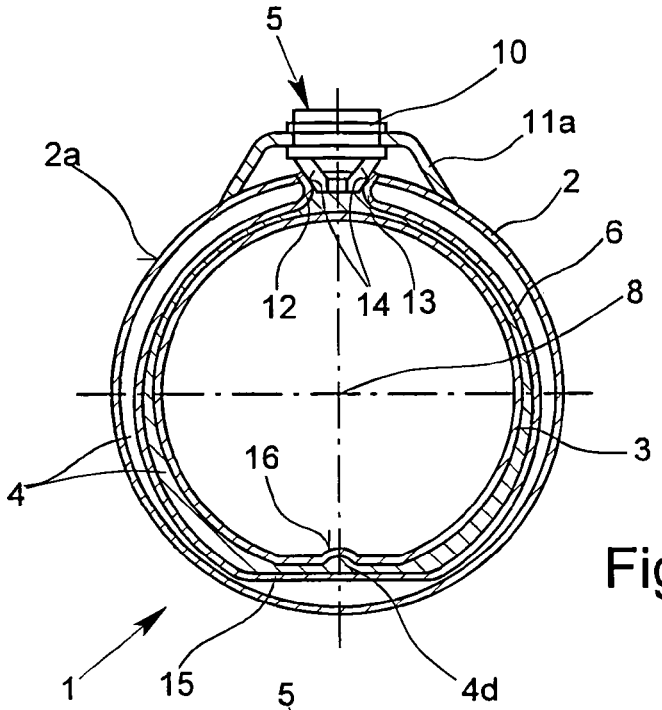
FIG. 12, a section along the line XII/XII in FIG. 10.
Figure 11:
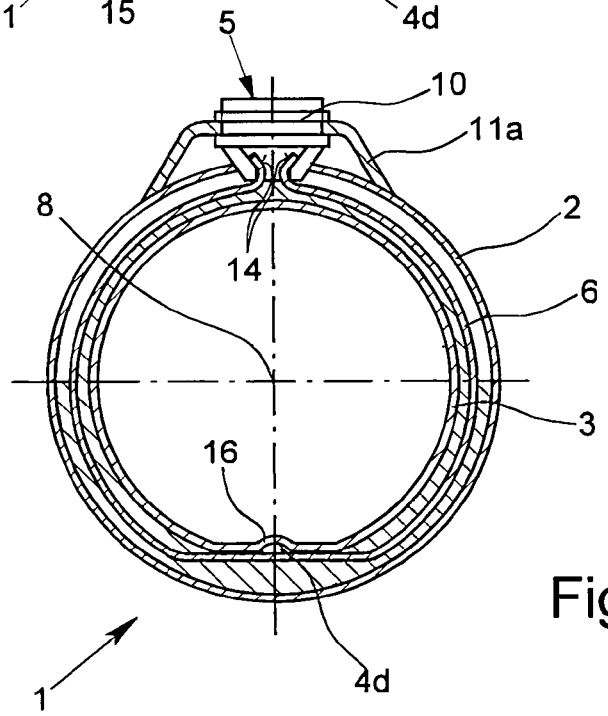
FIG. 11, a section along the line XI/XI in FIG. 9.
Figure 14:
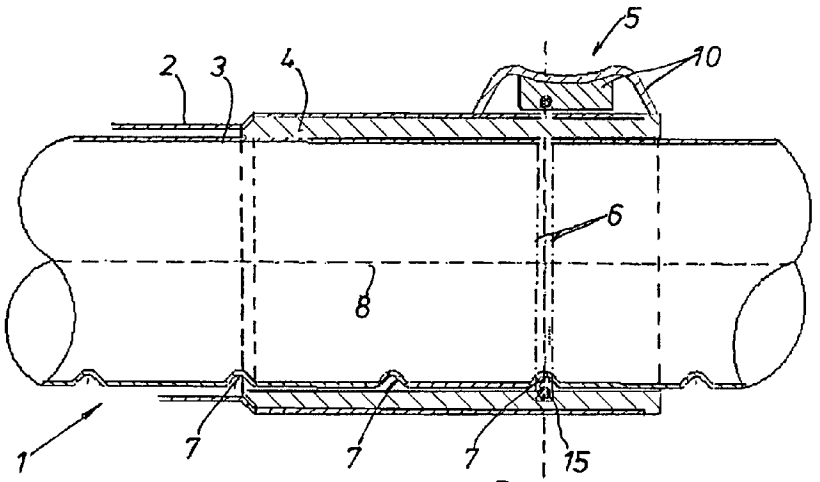
FIG. 14, a view according to FIG. 13 in the disengaged position of the snap-in element.
Figure 13:
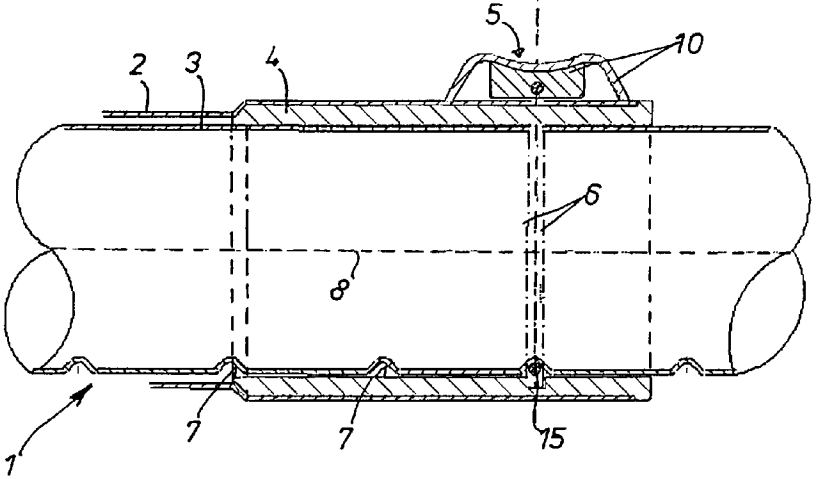
FIG. 13, a section according to FIG. 9 with a different variation of the slide and a bow spring of circular cross section in the engaged position of its snap-in element.

During a displacement in one of the two directions indicated by the double arrow 21 in FIG. 9, the slide 10 is guided within the stationary slide housing 11 a and the bow spring 6 is spread apart at its ends 12, 13. For this purpose, the slide 10 according to FIGS. 15 and 16 features two cone surfaces 10*a*, 10*b* that are rigidly connected to one another in the shape of an hourglass in their opposite pointed regions and spread apart the bow spring 6 when the slide 10 is moved parallel to the longitudinal symmetry axis 8 of the tubes 2, 3 in either direction indicated by the double arrow 21. When the slide 10 is released, it is displaced under the prestress of the bow spring 6 such that the ends 12, 13 of the bow spring 6 once again adjoin the narrowest point of the hourglass-shaped slide 10. These cone surfaces 10*a*, 10*b* form an angle $\alpha$ between 30° and 60°, preferably less than 45°, with a plane that extends through the longitudinal symmetry axis 8.

Alternatively, the cone surfaces 10*a* and 10*b* may also be realized in the form of parts of a quadrangular pyramid or partial generated surfaces of two straight circular cones, the outer surfaces of which are adjoined by the ends 12, 13 of the bow spring 6.

Figure 27:
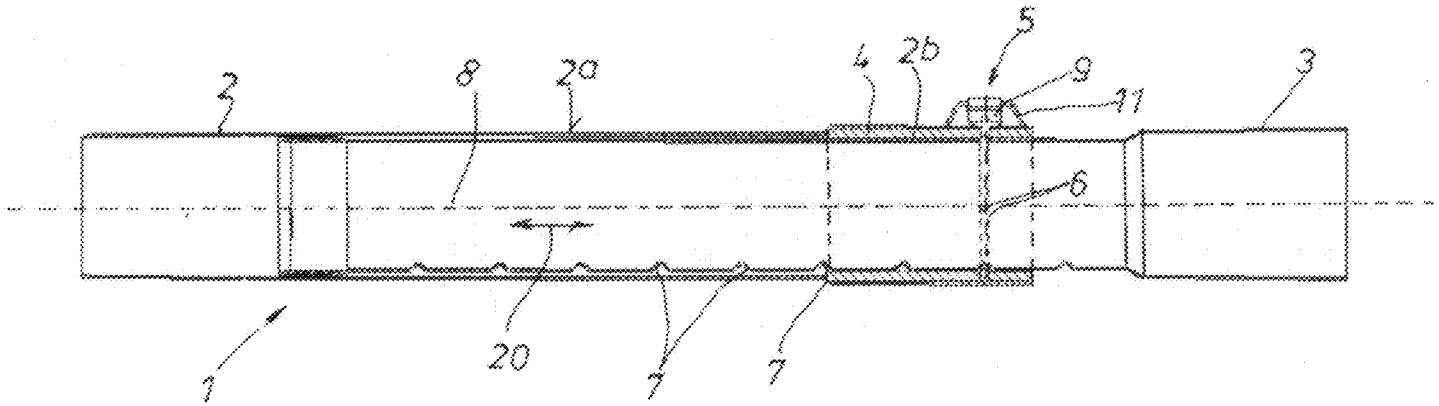
FIG. 27, a longitudinal section through a telescopic vacuum cleaner suction tube that corresponds to FIG. 1 and depicts a push-button and a bow spring of circular cross section, as well as the snap-in depressions of the inner tube that have the shape of a graduated circle and cooperate therewith.
Figure 28:
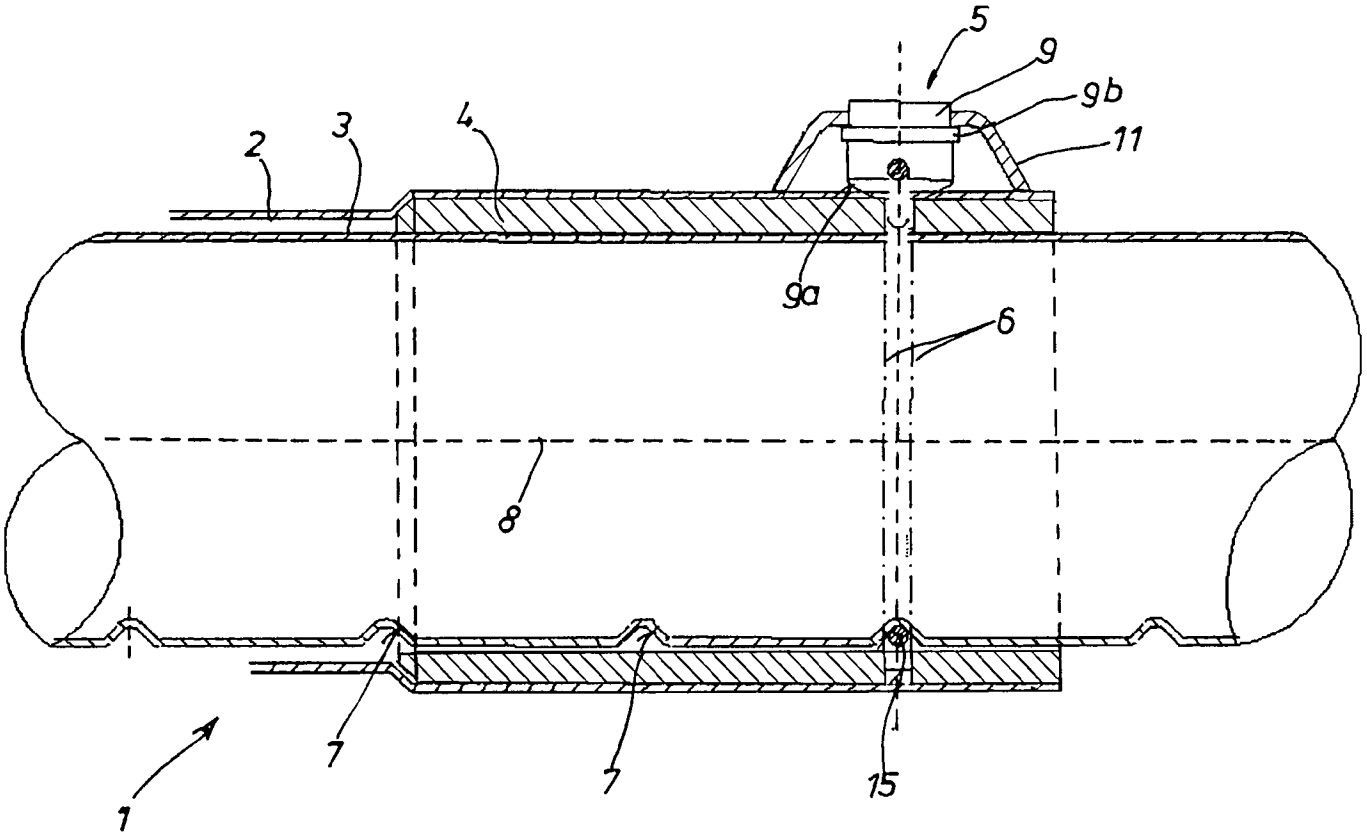
FIG. 28, a section through the region of the push-button and the guide sleeve that is enlarged in comparison with FIG. 27, namely in the engaged position of the snap-in element.
Figure 29:
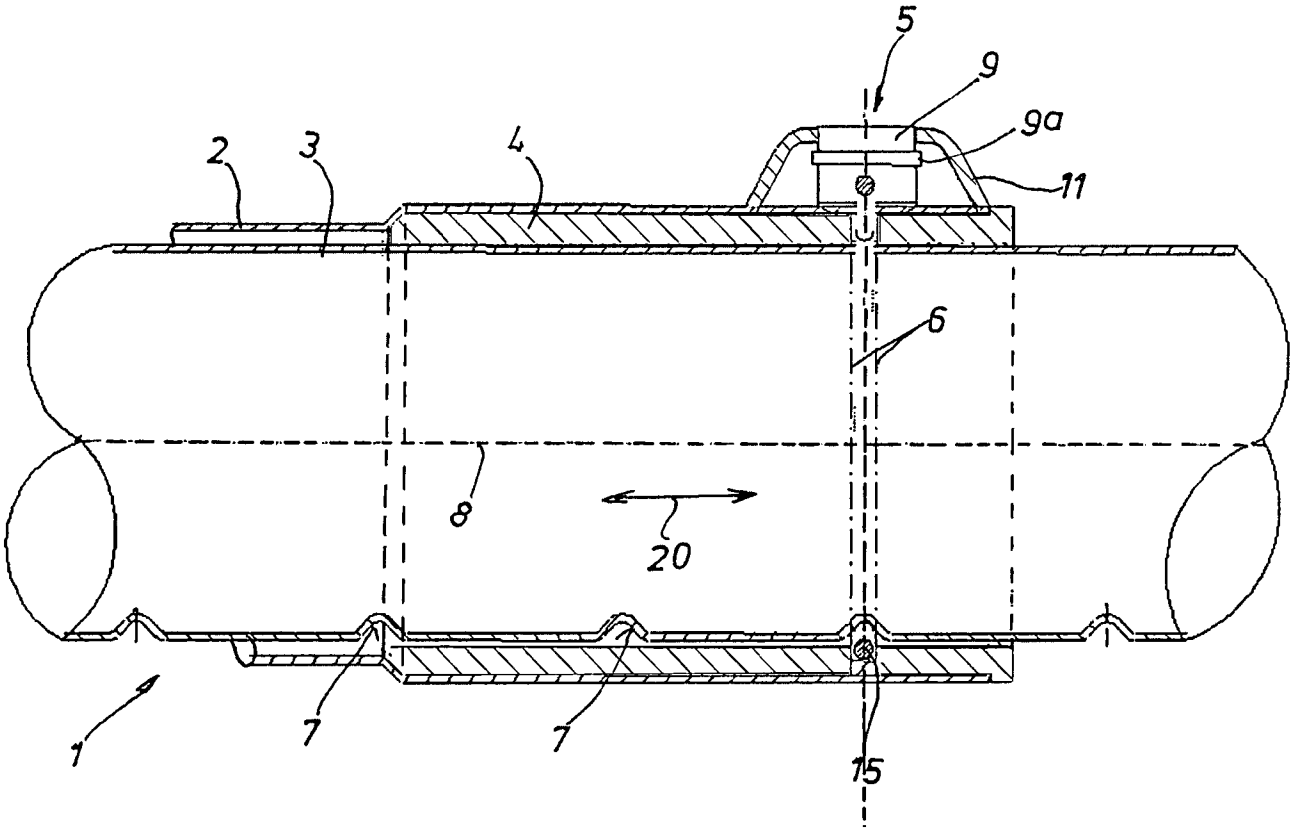
FIG. 29, the section according to FIG. 28 in the disengaged position of the snap-in element of the bow springs.

Another embodiment of the telescopic vacuum cleaner suction tube 1 is shown in FIGS. 27 to 29. In this case, components that correspond to the embodiment according to FIGS. 1 to 5 are identified by the same reference symbols. The essential differences between this embodiment and the embodiment according to FIGS. 1 to 5 can be seen in that the snap-in depressions 7 in the inner tube 3 are formed by semicircular graduated circles and the bow spring 6 has a circular cross section analogous to the embodiment according to FIGS. 30 to 33. The actuating element 5 is also realized in the form of a push-button 9 and situated in a push-button housing 11 as described above with reference to FIGS. 1 to 5. FIG. 28 shows the engaged position of the bow spring 6 with its snap-in element 15 while FIG. 29 shows the disengaged position of the snap-in element 15. The tubes 2, 3 can only be displaced relative to one another in the direction of the double arrow 20 in the position shown in FIG. 29. However, this embodiment has the disadvantage—exactly as in the state of the art—that the bow spring 6 can be spread apart and slide upward along the sliding surfaces of the snap-in depressions 7, namely into an undesirable disengaged position, if the ends of the inner tube 3 and/or the outer tube 2 are subjected to impulse-like shocks.

On the other hand, the embodiment shown in FIGS. 27 to 29 is extremely simple with respect to its design and its assembly.

Figures 30, 31, 32, 33, 34, 35, 36, 37:
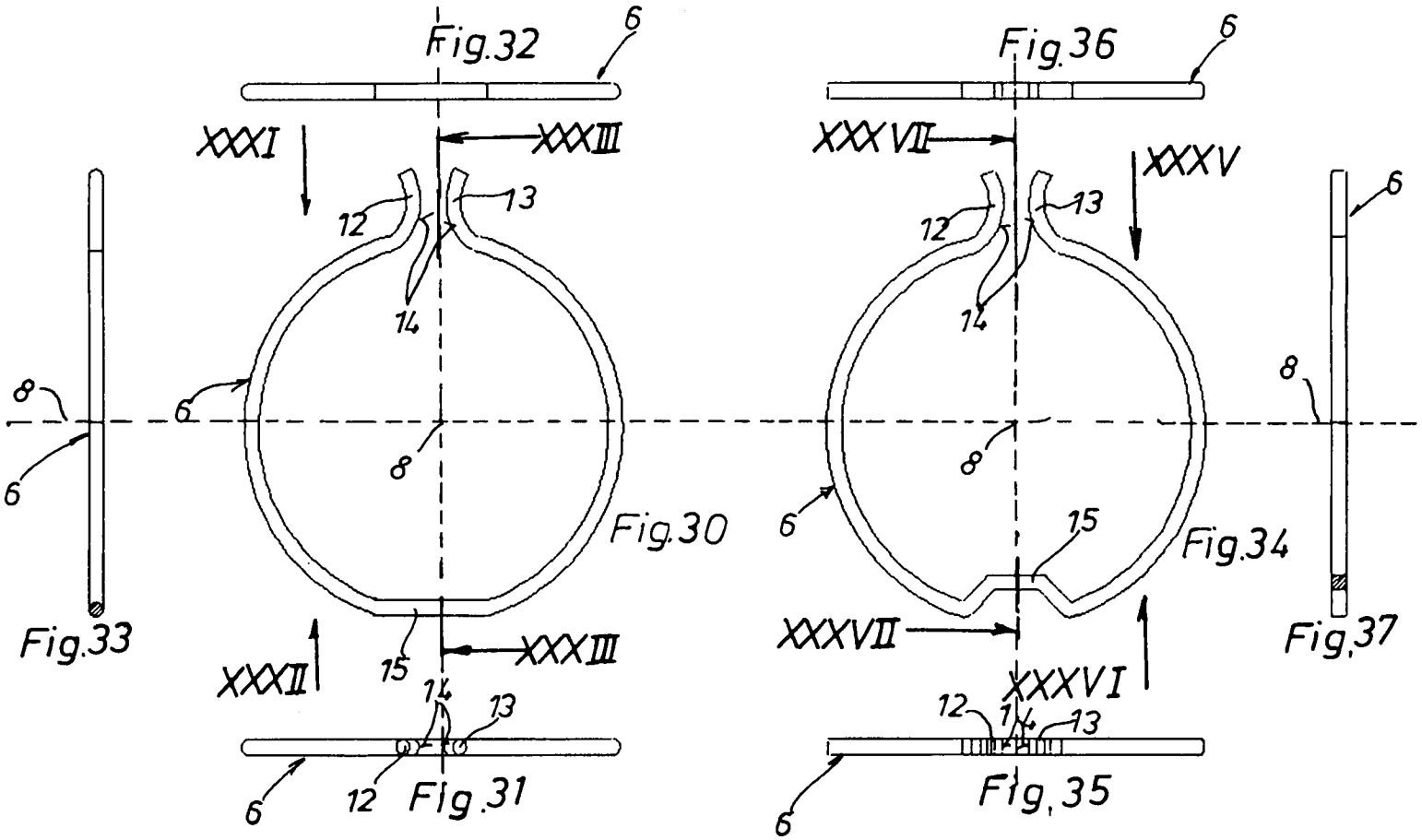
FIG. 30, a view of the bow spring of circular cross-section according to FIGS. 27 to 29.
FIG. 31, a top view of the bow spring in the direction of the arrow XXXI in FIG. 30.
FIG. 32, a bottom view of the bow spring with its snap-in element in the direction of the arrow XXXII in FIG. 30.
FIG. 33, a diametrical section through the bow spring according to FIG. 30 along the line XXXIII/XXXIII.
FIG. 34, a second embodiment of a bow spring of rectangular cross-section, in this case of approximately square cross-section, and a snap-in element in the form of a defined locking projection.
FIG. 35, a top view of the bow spring according to FIG. 34 in the direction of the arrow XXXV.
FIG. 36, a bottom view of the bow spring according to FIG. 34 in the direction of the arrow XXXVI.
FIG. 37 a section through the bow spring along the arrows XXXVII/XXXVII in FIG. 34.
Figure 39:
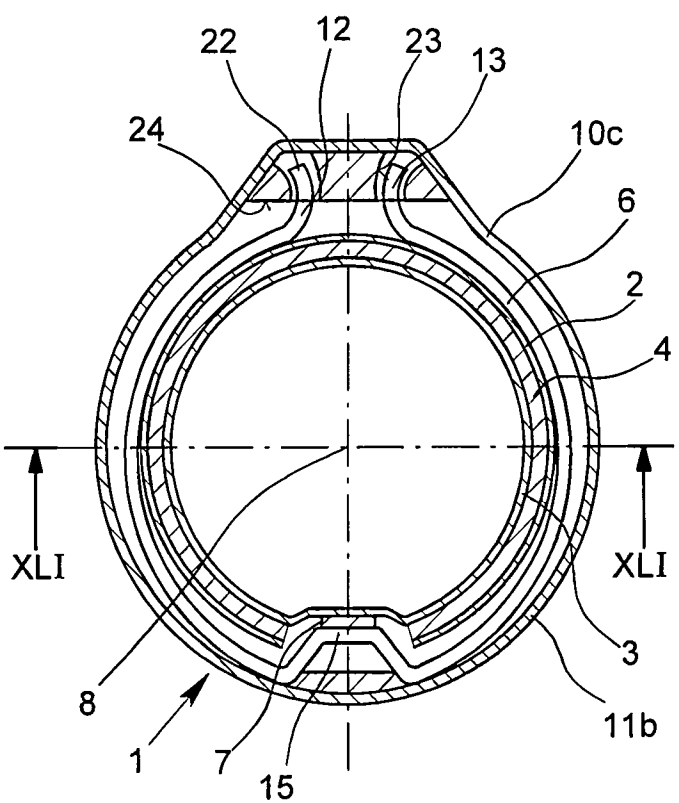
FIG. 39, a sectional representation according to FIG. 38 in the disengaged position of the snap-in element of the bow spring.

Another embodiment of a telescopic vacuum cleaner suction tube 1 with an actuating element 5 in the form of a slide is illustrated in FIGS. 38 to 41, wherein the corresponding bow spring 6 is illustrated in FIGS. 34 to 37. In this embodiment, the slide 11*b* is realized in the form of a tubular sliding sleeve 11*b* that encompasses the outer tube of the telescopic vacuum cleaner suction tube 1 in a section the corresponds to about the length of the guide sleeve 4. This slide 11*b* features guide grooves 22, 23 on its surface areas 24 that face the free, outwardly bent ends 12, 13 of the bow spring 6, wherein the ends 12, 13 of the bow spring 6 are guided in the aforementioned guide grooves and spread apart when the slide 11*b* is displaced parallel to the longitudinal symmetry axis 8 in either direction indicated by the double arrow 21 in FIGS. 40 and 41, namely because the guide grooves 22, 23 according to FIGS. 40 and 41 extend in a diverging fashion. This divergence is located to both sides of the narrowest point 25 of the guide grooves 22, 23. The locking projection 15 may either be flattened in accordance with FIGS. 11 and 12 and have a rectangular cross-sectional shape or a trapezoidal shape as shown in FIG. 34. In this case, the geometry of the snap-in depressions 7 also needs to be adapted accordingly such that they have a similar cross-sectional shape, i.e., a trapezoidal cross-sectional shape in this case.

Figure 38:
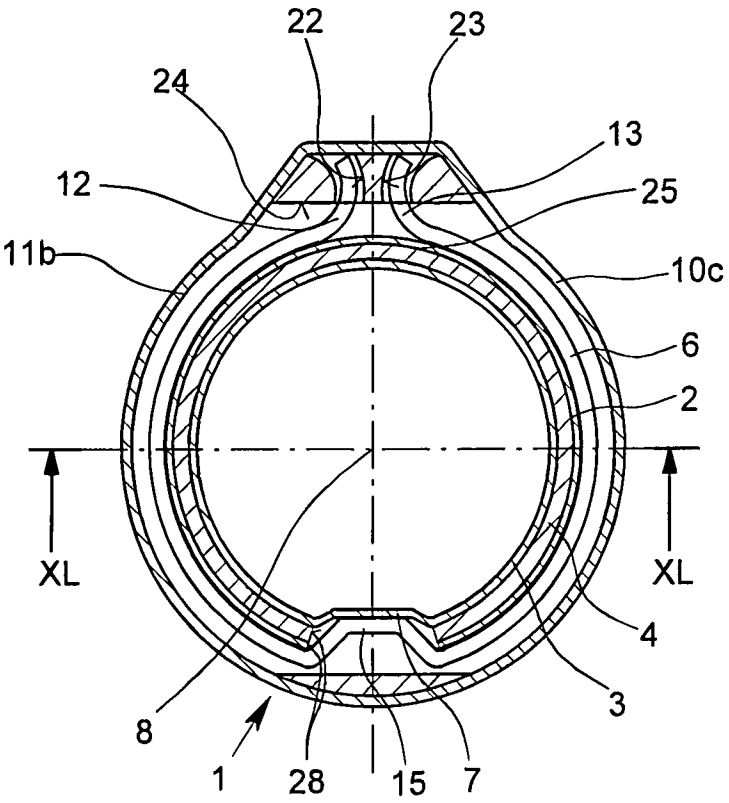
FIG. 38, another embodiment of a telescopic vacuum cleaner suction tube with the bow spring of approximately square cross-section according to FIGS. 34 to 37 in the engaged position of the snap-in element, wherein the bow spring encompasses the outer tube and engages into a snap-in depression of the inner tube with its snap-in element, namely through an opening in the outer tube and the guide sleeve.

One noteworthy peculiarity of the embodiment according to FIGS. 38 to 41 is that the bow spring 6 positively and non-positively encompasses the outer tube 2 and engages into the snap-in depression 7 of the inner tube 3 through an opening 28 in the outer tube 2 as well as the guide sleeve 4 as shown in FIG. 38.

Figure 41:
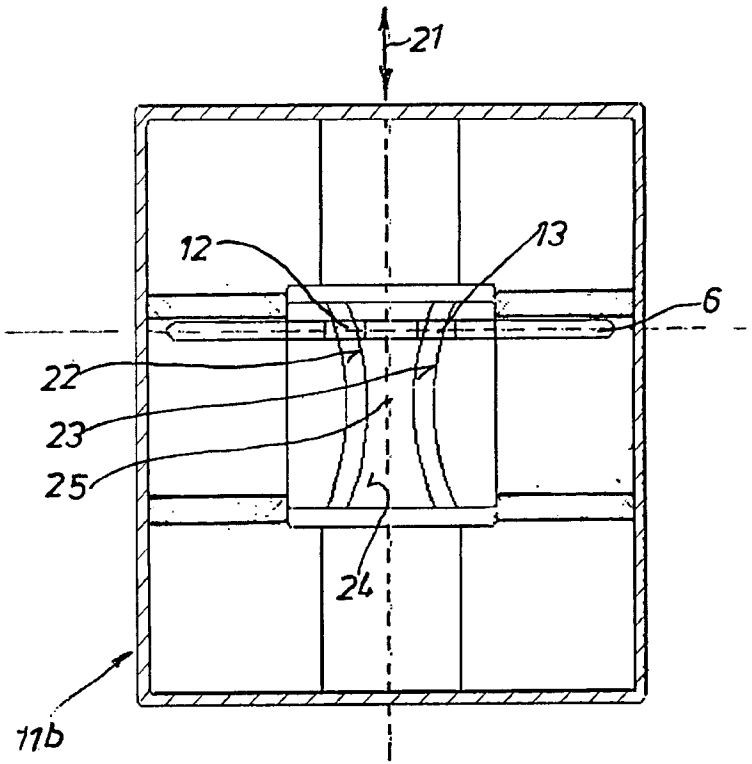
FIG. 41, a bottom view along the line XLI/XLI in FIG. 39 in the disengaged position of the bow spring and without the outer and inner tubes.
Figure 40:
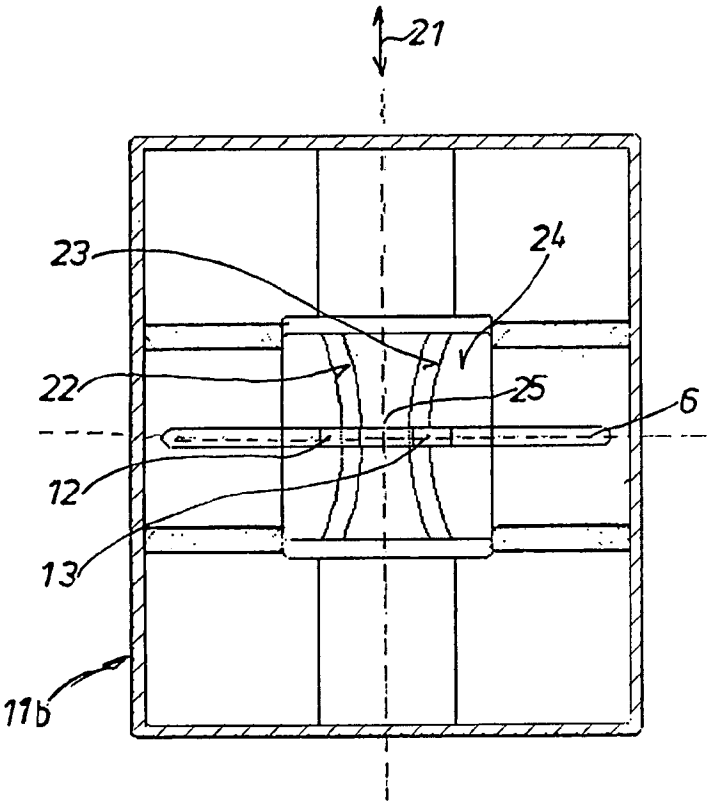
FIG. 40, a bottom view of the slide with the bow spring in the direction of the arrows XL/XL in FIG. 38, namely in the engaged position and without the outer and inner tubes.

In this embodiment, a displacement in either of the two possible directions indicated by the double arrow 21 in FIG. 1 and FIGS. 40 and 41 causes the ends 12, 13 of the bow spring 6 to be spread apart such that the snap-in element 15 is lifted out of the snap-in depression 7. When the sleeve-shaped slide 11*b* is released, it is displaced into the position in which these ends 12, 13 are spaced apart from one another by the shortest distance (see FIG. 38 in connection with FIG. 40) under the prestress of the bow spring 6. In this position, the snap-in element 15 once again engages into the nearest snap-in depression 7. The bow spring 6 also fulfills the three previously described functions in this embodiment.

Figure 42:
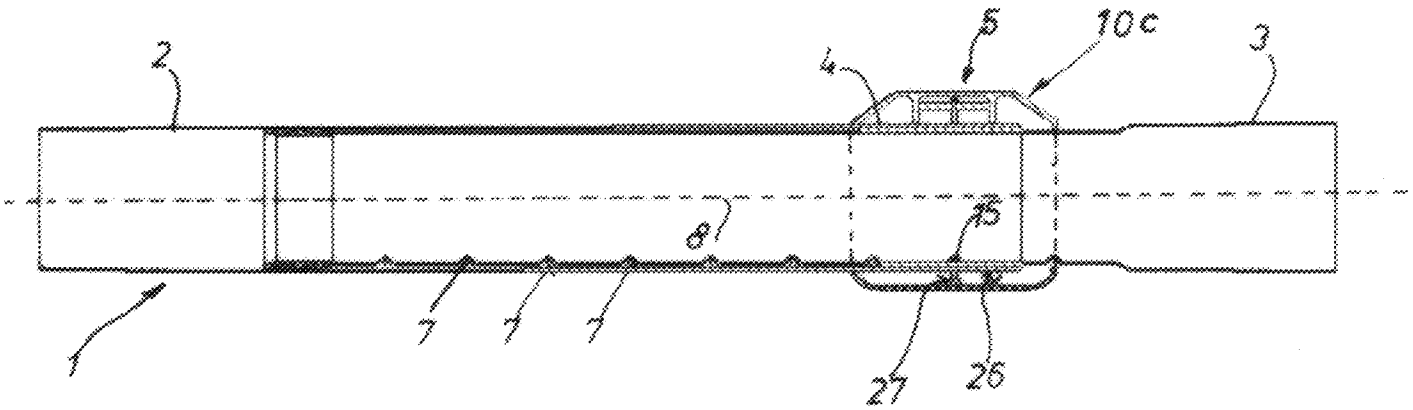
FIG. 42, a longitudinal section through a telescopic vacuum cleaner suction tube according to FIG. 23 with a bow spring of circular cross-section and snap-in depressions in the shape of a graduated circle in the inner tube, however, with an actuating element in the form of a sliding sleeve that encompasses the outer tube and the inner tube, as well as a safety projection arranged therein.
Figure 44:
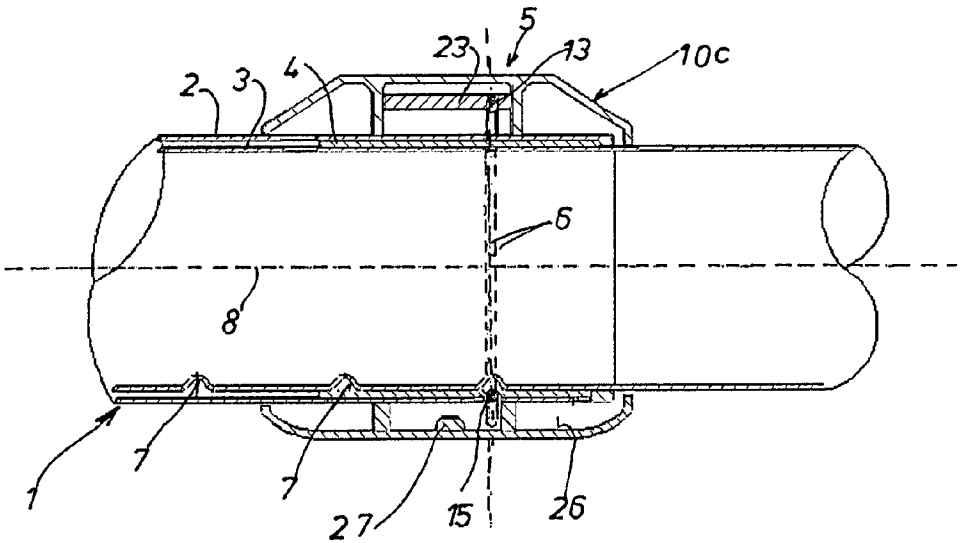
FIG. 44, a section according to FIG. 43 in the disengaged position of the snap-in element of the bow spring, and FIG. 45, a sectional representation according to FIG. 11 through another embodiment of a telescopic vacuum cleaner suction tube with an outer tube, an inner tube and a bow spring, wherein this embodiment features no guide sleeve, but rather four pairs of projections on the inner side of the outer tube in order to hold the bow spring and to space apart the outer tube from the inner tube.
Figure 43:
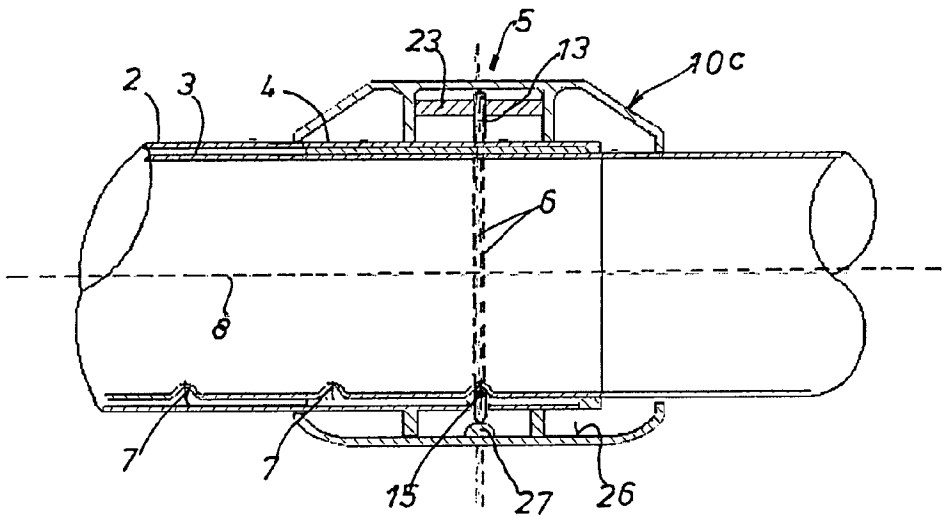
FIG. 43, an enlarged section through the region of the sliding sleeve according to FIG. 42, namely in the engaged position of the bow spring with a safety projection engaging underneath the snap-in element.

Another embodiment of the telescopic vacuum cleaner suction tube 1 with a tubular sliding sleeve 10*c* is illustrated in FIGS. 42 to 44. The difference in comparison with the embodiment with a push-button 9 according to FIGS. 27 to 29 can be seen in that the bow spring 6 of circular cross section and its snap-in element 15 cooperate with a sliding sleeve 10*c* that features the same guide grooves 22, 23 for spreading apart the ends 12, 13. The snap-in depressions 7 are realized in the shape of graduated circles in accordance with the circular cross section of the bow spring 6. If both ends of the outer and inner tubes 2, 3 are subjected to shock-like impulses, it is disadvantageous that the snap-in element 15 of the bow spring 6 may slide upward on the snap-in depressions in the shape of graduates circles similar to the initially described state of the art and the embodiment shown in FIGS. 27 to 29. This is prevented in that the actuating element 5 is realized in the form of a sliding sleeve 10*c* that completely encompasses the outer tube 2 and features a safety projection 27 on its inner surface 26 that lies closest to the snap-in element 15 in its engaged position, wherein said safety projection engages underneath the snap-in element 15 in exactly its central region in the engaged position according to FIGS. 42 and 43. Consequently, not even shock-like impulses exerted upon both ends of the tubes 2, 3 can result in the bow spring 6 being spread apart and the snap-in element 15 being lifted or pressed out.

In the embodiment shown in FIGS. 42 to 44, the safety projection 27 is rounded. However, it may also be provided with not-shown conical lateral surfaces. The design of the curved paths with the guide grooves 22, 23 is advantageously adapted to the design of the safety projection 27. In order to prevent the safety projection 27 from creating an obstruction while the interlocked tubes is disengaged, it is advantageous that the ends 12, 13 of the bow spring 6 are initially guided along a path that extends parallel to the longitudinal symmetry axis 8 and subsequently on the diverging curved paths 22, 23 such that the spreading of the bow spring and therefore the disengaging the snap-in element 15 from the respective snap-in depressions 7 can always takes place in a controlled fashion.

Figure 45:
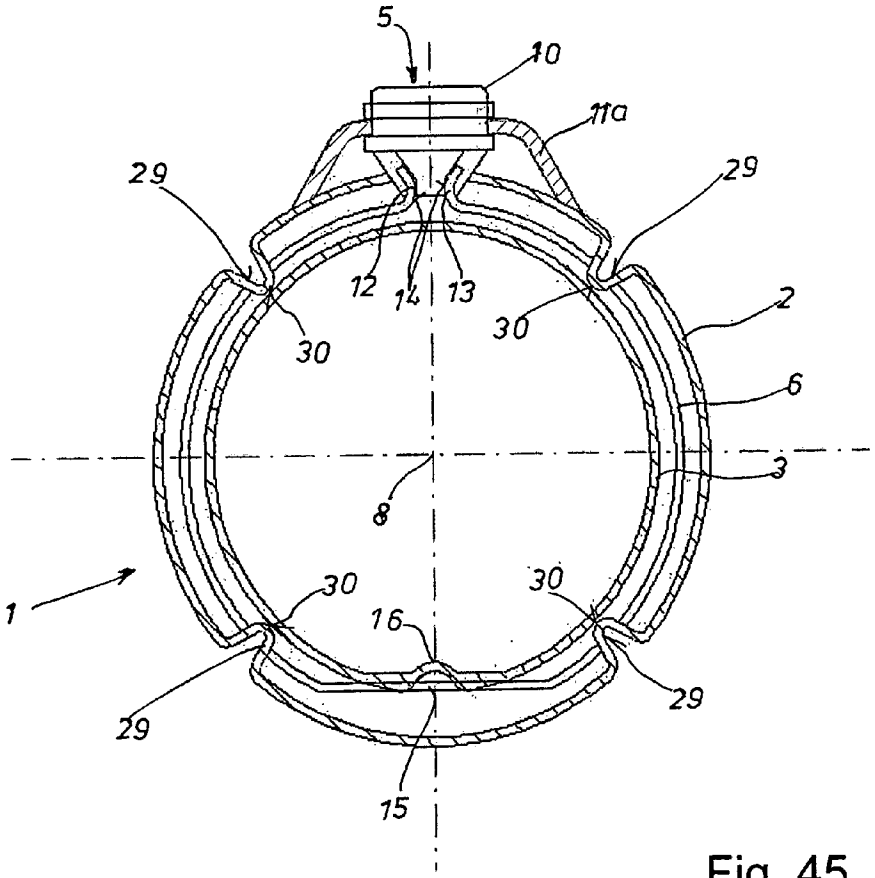

FIG. 45 shows a cross-sectional representation of another embodiment of a telescopic vacuum cleaner suction tube 1, in which the outer tube 2 is provided with four pairs of projections 29, between which the bow spring 6 is held and the rounded ends 30 of which form spacers between the outer tube 2 and the inner tube 3. Consequently, the guide sleeve 4 can be eliminated. Since the antitwisting mechanism is also provided in this case, the guide sleeve may merely consist of a narrow ring sleeve 4*c* in connection with the projection 4*d* according to FIG. 23. In other respects, components that correspond to the embodiment according to FIGS. 9 to 12 are identified by the same reference symbols. Due to the elimination of the guide sleeve 4 shown in FIGS. 23 to 26, this embodiment can also be referred to as a budget version. It goes without saying that the slide 10 could also be replaced with a push-button 9.

The bow spring 6 advantageously consists of spring steel and is arranged on a circumferential groove 4*e* (see FIGS. 23 and 26) of the guide sleeve 4 such that it can be spread apart. This guide sleeve 4 is made of plastic and advantageously arranged stationarily at the end of the outer tube 2 in an intermediate space 2*c* according to FIGS. 2 and 3 between a widened end 2*d* of the outer tube 2 and the outer surface 3*a* of the inner tube 3, e.g., by means of bonding or a press fit or the like.

In all embodiments, the core of the invention consists of realizing the interlocking device with only two parts, namely the bow spring 6 and the actuating element 5 that may consist of a push-button 9 or a slide 10, 10*c*, 11*b*. A long service life as well as an exceptionally small clearance between the outer tube 2 and the inner tube 3 is ensured with this robust design.

Only a bow spring 6 of rectangular and circular cross section was claimed in a representative capacity for a plurality of cross-sectional shapes in claim 1 and realized in the form of a non-published prototype. However, it goes without saying that the scope of the invention also includes embodiments with elliptical, oval, triangular, trapezoidal, hexagonal or octagonal cross-sectional shapes of the bow spring 6, as well as multiples thereof, without deviating from the equivalency scope of the invention.

LIST OF REFERENCE SYMBOLS

Telescopic vacuum cleaner suction tube 1
Outer tube of 1 2
Upper side of outer tube 2 2*a*
Widening of outer tube 2 2*b*
Intermediate space/end region of outer tube 2 2*c*
Widened end of outer tube 2 2*d*
Inner tube of 3
Surface of inner tube 3 3*a*
Guide sleeve 4
Openings 4*a*, 4*b*
Narrow ring sleeve 4*c*
Antitwisting mechanism 4*d*/16
Circumferential groove of guide sleeve 4 4*e*
Actuating element 5
Bow spring 6
Snap-in depressions 7
Edges of snap-in depressions 7*a*
Longitudinal symmetry axis 8
Push-button 9
Conical or wedge-shipped end of push-button 9 9*a*
Slide 10
Cone surfaces of slide 10 10*a*, 10*b*
Sliding sleeve 10*c*, 11*b*
Housing of push-button 9 11
Slide housing 11*a*
Free ends of bow spring 6 12, 13
Intermediates space 14
Snap-in element 15
Edges of snap-in element 15*a*
Double arrow 17, 19, 20, 21
Guide grooves of slide 10*c* 22, 23
Surface area of slide 10*c* 24
Narrowest point of guide grooves 22, 23 25
Inner surface of slide 10*c* 26
Safety projection on inner surface 26 27
Opening in outer tube 2 and guide sleeve 4 28
Guide projections in outer tube 2 29
Rounded ends of 29 30

What is claimed is:

1. A telescopic vacuum cleaner suction tube, comprising:

an outer tube through which a vacuum can be drawn, an inner tube through which a vacuum can be drawn and that is provided with at least one axial row of snap-in depressions, the inner tube being slidable in an axial direction within the outer tube in a telescopic manner, an anti-twisting mechanism and an interlocking device with a spring which has a snap-in element formed on the spring between free ends of the spring, and the snap-in element engaging into a nearest one of the snap-in depressions of the inner tube under the prestress of the spring, an actuating element situated in a gap between the free ends of the spring and being operable for disengaging the snap-in element from the one of the snap-in depressions in which the snap-element is engaged, and a guide sleeve which restrains the spring from axial movement without the spring being mechanically fastened to either the inner tube or the outer tube, wherein the spring encompasses one of the outer tube and the inner tube, wherein the actuating element is operable for moving the free ends of the spring relative to each other to flex the spring in a manner forcing the snap-in element radially out of the snap-in depression in which it is engaged to free the tubes for relative axial sliding movement, wherein the actuating element is formed by a push-button on the outer tube that is movable in a direction perpendicular to said axial direction, characterized in that the push-button engages into the funnel-shaped intermediate space (14) between inwardly or outwardly bent ends (12, 13) of the spring (6) with its conical or wedge-shaped end (9*a*) that faces the spring (6), and upon release, the push-button is raised into a raised starting position within a surrounding housing (11) under the prestress of the spring (6) in the engaged position of the suction tube.

2. The telescopic vacuum cleaner suction tube according to claim 1, characterized in that the push-button (9) for disengaging the interlocked tubes is pressed downward in the direction of the surface (3*a*) of the inner tube (3), into the funnel-shaped intermediate space (14) between the inwardly or outwardly bent ends (12, 13) of the spring (6), while the snap-in element (15), which is diametrically opposite the ends (12, 13), is disengaged from the snap-in depression (7) of the inner tube (3).

3. The telescopic vacuum cleaner suction tube according to claim 1, characterized in that the snap-in depressions (7) of the inner tube (3) have a flat rectangular shape.

4. A telescopic vacuum cleaner suction tube, comprising:

an outer tube through which a vacuum can be drawn, an inner tube through which a vacuum can be drawn and that is provided with at least one axial row of snap-in depressions, the inner tube being slidable in an axial direction within the outer tube in a telescopic manner, an anti-twisting mechanism and an interlocking device with a spring which has a snap-in element formed on the spring between free ends of the spring, the spring encompassing at least the inner tube and the snap-in element engaging into a nearest one of the snap-in depressions of the inner tube under the prestress of the spring, an actuating element situated in a gap between the free ends of the spring and being operable for disengaging the snap-in element from the one of snap-in depressions in which the snap-in element is engaged, and a guide sleeve which restrains the spring from axial movement without the spring being mechanically fastened to either the inner tube or the outer tube, wherein the spring encompasses one of the outer tube and the inner tube, wherein the actuating element is operable for moving the free ends of the spring relative to each other to flex the spring in a manner forcing the snap-in element radially out of the snap-in depression in which it is engaged to free the tubes for relative axial sliding movement, wherein the actuating element is formed by a push-button on the outer tube that is movable in a direction perpendicular to said axial direction, characterized in that the spring (6) is arranged on a circumferential groove (4*e*) of the guide sleeve (4) such that it can be spread apart, wherein said guide sleeve is arranged stationary between the outer tube and the inner tube (2, 3), namely at the end of the outer tube (2) in a widened end region (2*c*) of the outer tube (2).

5. The telescopic vacuum cleaner suction tube according to claim 4, characterized in that the free ends (12, 13) of the spring (6) are bent inward or outward in a funnel-shaped fashion in the vicinity of the actuating element (5).

* * * * *